United States Patent [19]

Hillstrom

[11] 4,145,828

[45] Mar. 27, 1979

[54] POSTER DISPLAY DEVICE

[75] Inventor: David U. Hillstrom, Novi, Mich.

[73] Assignee: Marketing Displays, Inc., Farmington Hills, Mich.

[21] Appl. No.: 840,780

[22] Filed: Oct. 11, 1977

[51] Int. Cl.[2] ..... G09F 1/12

[52] U.S. Cl. ..... 40/156; 40/13

[58] Field of Search ..... 40/13, 152, 156

[56] References Cited

U.S. PATENT DOCUMENTS

| | | | |
|---|---|---|---|
| 2,882,633 | 4/1959 | Howell | 40/156 |
| 3,205,601 | 9/1965 | Gawne et al. | 40/13 X |
| 3,310,901 | 3/1967 | Sarkisian | 40/13 X |
| 3,386,198 | 6/1968 | Howell | 40/156 |

*Primary Examiner*—Louis G. Mancene
*Assistant Examiner*—Wenceslao J. Contreras
*Attorney, Agent, or Firm*—Harness, Dickey & Pierce

[57] ABSTRACT

An improved poster frame and display holder for replaceable posters and similar advertising material. The sides of the frame comprise sets of pivotably engaged extruded metal parts. Improved leaf-type spring mechanisms bias together the portions of each side of the frame for releasably holding a poster or similar display.

13 Claims, 4 Drawing Figures

POSTER DISPLAY DEVICE

BACKGROUND — SUMMARY OF THE INVENTION

The present invention relates to an improved poster frame and display holder for various types of replaceable posters and similar advertising materials. The frame and holder can be utilized in many various areas, such as on buses, street cars, taxicabs, and similar mobile installations, as well as on fixed mounts such as at service stations, on building walls, on posts and the like. They also can be displayed either indoors or outdoors.

The present invention is an improvment over the invention disclosed and claimed in U.S. Let. Pat. No. 3,310,901. In that patent, a unique and highly advantageous display holder is set forth. The display holder has four sets of extruded metal parts pivotably mated together. Snap-over, a cantilever action-type leaf springs with S-shaped hooks at one end are utilized to bias together the two parts of the frame. The bight portions forming the S-shaped hooks aid in assembling the mating extrusion sections, prevent the spring from coming out of its seat, and allow the extrusion sections to remain in prespecified positions for removing and clamping the display items. The biased extruded frame sections coact to releasably clamp posters or similar display items in the frame.

The present invention provides a poster frame and display holder which is less expensive to manufacture and assemble than the highly successful subject matter of U.S. Pat. No. 3,310,901. The spring biasing mechanism comprises a single-piece metal leaf spring without any hooks, bights or pre-formed curvatures at either end. The mating frame portions have improved recesses or seats formed in them for securely holding the two ends of the leaf spring. The improved springs are made of less material, require less stringent tolerances, do not need forming or rolling, and thus are less expensive to produce. The new spring mechansims also are easier to install between mating frame sections and thus result in less expensive assembly of the frame.

It is an object of the present invention to provide a unique and beneficial poster frame and display holder for use in various applications. It is another object to provide a highly durable, weather-resistant poster frame and display holder which can be used both indoors and outdoors and which will provide a reliable and pleasant appearing construction throughout its lifetime. It is still another object to provide a display holder and poster frame which is an improvement over the invention of U.S. Pat. No. 3,310,901.

Other objects, features and advantages of the invention will become apparent from the following description of the invention when viewed in accordance with the accompanying drawings.

BRIEF DESCRIPTION OF THE DRAWINGS

FIG. 3 is a cross-sectional view taken along line 3—3 in FIG. 1; and

DESCRIPTION OF THE PREFERRED EMBODIMENTS

Figures 1, 2:
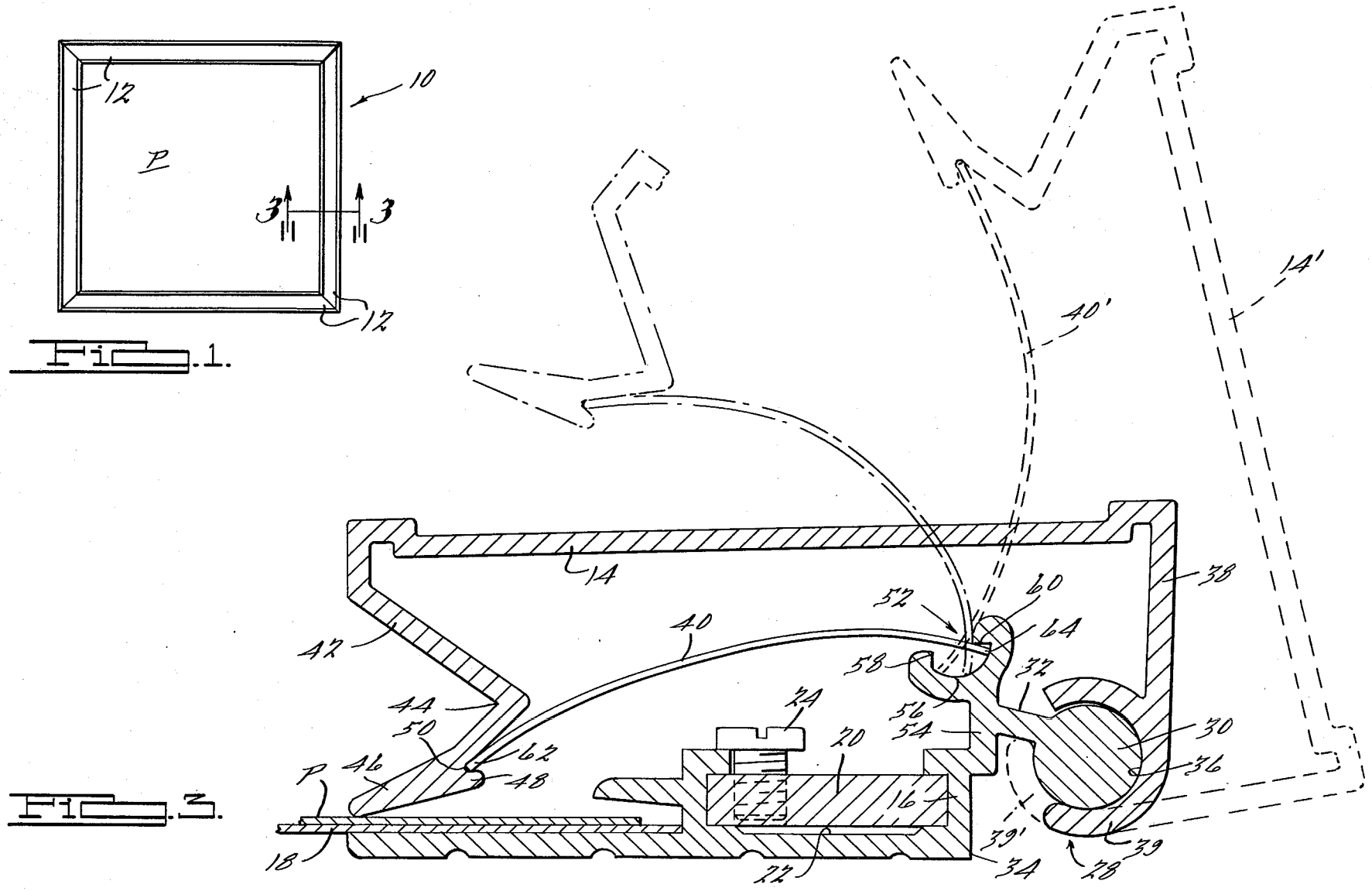
FIG. 1 is a front view of an improved display holder in accordance with the invention.
FIG. 2 is a fragmentary perspective view of a corner section of the display holder shown in FIG. 1.
Figure 2:
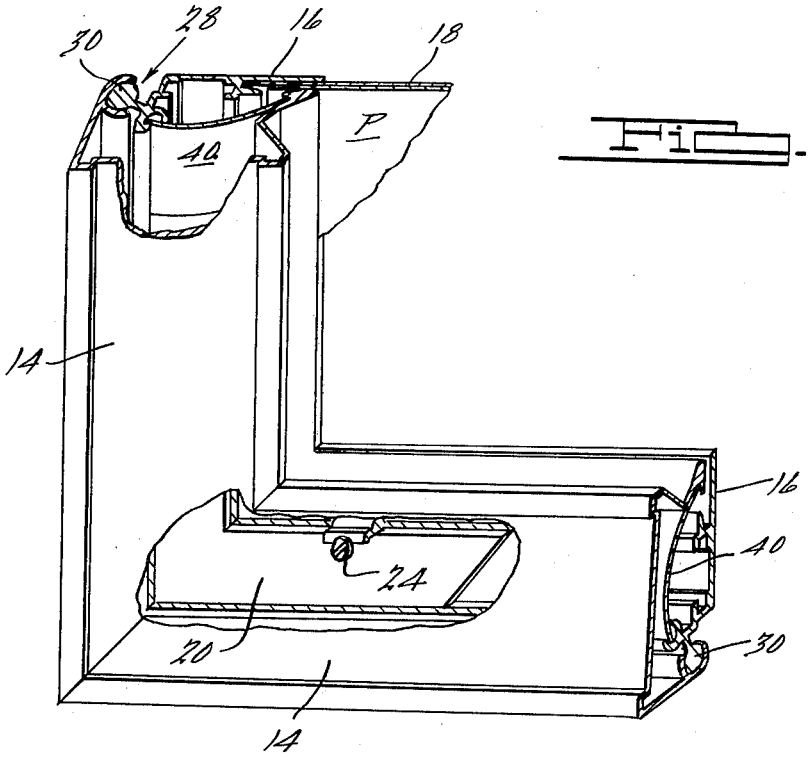

As illustrated in FIG. 1, the improved display holder and poster frame, generally designated by the reference numeral 10, is made up of a plurality of frame sections 12. As shown in FIGS. 2 and 3, each of the sections 12 are made essentially of two extruded metal portions 14 and 16 which are pivoted together. The portions 14 and 16 of each section 12 are cut to the desired length and mitred 45° at their opposite ends for abutting and coplanar assembly with one another to outline the frame 10. As will be understood, the frame 10 can be square or rectangular, although it is also possible for the frame 10 to have any desired polygonal shape with an appropriate number of sections 12 mitred at appropriate angles. Also, it is possible for each of the front or cover extrusions 14 to be comprised of a number of extruded pieces of shorter length.

The frame 10 preferably has associated with it a rigid backing member 18 which can be made of Masonite, aluminum or another suitable material. The sections 12 are postioned around the edges of the backing member 18 to form the completed display holder. A poster P or other display member is positioned on the backing member 18 and held in place around its edges by the sections 12. The back extruded portion 16 can be fastened in any conventional means to a rigid or supporting member, such as a post, wall or the like. It is also understood that the use of a backing member 18 is not necessary; the frame 10 could be mounted on a flat surface forming its own backing member, or the poster P could be made of a rigid or stiff material without the need for a backing member.

The portions 14 and 16 are preferably made of a material which can be efficiently and economically extruded, presents an attractive external appearance, and maintains a pleasing and durable structure for an indefinite length of time. Suitable materials include plastic, aluminum and magnesium.

Adjacent sections 12 of the frame 10 are held and fastened together by corner braces 20, which preferably are L-shaped steel stampings. The braces 20 are positioned in suitable recesses 22 in each of the back portions 16 and held in place therein by screws 24. This is described in detail in U.S. Pat. No. 3,310,901, and disclosure of which is incorporated herein by reference.

The outer or front portion 14 of each frame section 12 is assembled to the back portion 16 by means of a hinge assembly 28. The assembly 28 is comprised of a cylindrical hinge or pivot pintle formation 30 extending outwardly by bridge element 32 from the back wall 34 of portion 16 and a corresponding cup-shaped formation 36 formed on the back panel 38 of portion 14. The edges of the cup 36 preferably extend more than 180° about the pivot 30 and the two sections 14 and 16 thus are either slidably assembled in the longitudinal direction or snapped together. As shown by the dashed outlines of FIG. 3, the hinge assembly 28 allows the cover portion 14 to pivot relative to the back portion 16. When the cover portion 14 is in the position shown in solid lines in FIG. 3, it holds the poster P in position in the frame against the backing member 18. When it is desired to remove or replace the poster P, the cover portion 14 is rotated or pivoted to the dashed outline position 14' permitting removal of the poster. The rotation of portion 14 is limited by stop end 39 of back panel 38; when the portion 14 is swung to its fully open position (14'), the end 39 rests against bridge element 32 (as shown by numeral 39' in FIG. 3).

One or more leaf springs 40 are positioned in each section 12 between the portions 14 and 16. The springs 40 bias the two portions relative to one another: the springs 40 act to maintain a snug mating pivotal engagement of portions 14 and 16, bias the cover portions 14 against the poster P and the backing member 18 when the frame sections are "closed," and hold the cover portions in their "open" upright position (14' in FIG. 3) for removal or replacement of poster P. The spring 40 is preferably made of a good grade of spring steel and has a flat, rectangular shape. It is adapted to be flexed when the cover portion 14 is rotated, as discussed above, and provides the desired cantilever snap-action therefor.

Extrusion portion 14 has an attractively curved side panel 42 thereon with a longitudinal groove 44 formed in it. The groove 44 is provided so that portion 14 may be grasped in manipulation to open or close it relative to portion 16. The end 46 of side panel 42 is adapted to rest on the poster P and clamp it in place in the display holder. An outwardly and upwardly hook formation 48 is provided adjacent end 46. The hook formation 48 forms a longitudinal groove or recess 50 within which one end 62 of spring 40 is positioned when portions 14 and 16 are assembled together and the spring 40 is installed in place. The groove 50 has sufficient depth so that the end of spring 40 will not be displaced therefrom when the portion 14 is opened and closed.

The opposite end 64 of leaf spring 40 is positioned in an arcuate-shaped channel 52 in upstanding flange formation 54 of portion 16. The channel 52 runs longitudinally in portion 16 and its arcuate section 56 extends approximately 90°. The arcuate section 56 is bounded on its two sides by flat walls 58 and 60, the planes of which are substantially perpendicular to each other. The shape and position of the channel 52 allows unrestricted movement of end 64 of spring 40 over a 90° arc as the cover portion 14 is opened and closed and also prevent the end 64 from being displaced therefrom. The channel 52 further allows use of a flat leaf spring 40 which can be easily manufactured without expensive and time-consuming roll forming and bending, which does not have to be manufactured and fabricated within stringent tolerance limits, and which can be quickly and easily installed in the frame sections 12.

In the assembly of the frame sections 12, the portions 14 and 16 are first longitudinally slid or snapped together at the hinge assembly 28. Next, the extruded portions 14 and 16 are brought into end-to-end lateral register with one another. So associated, the cover extrusion 14 is fully swung to its open position (14' in FIG. 3) — as limited by stop end 39 — and end 64 of spring 40 is positioned in arcuate channel 52. A force is then applied to spring 40 until the end 63 thereof is slid past the end of hook formation 48 and snapped into its final position in groove 50.

When the various portions of the frame sections 12 are assembled in place as shown in FIGS. 2 and 3, the cantilever acting leaf spring 40 exerts sufficient friction against the cover portion 14 to resist longitudinal shift of back portion 16 at the hinge assembly 28. The spring 40 also exerts an inward and outward over-center force to stably retain the movable frame section portions in either their closed or open positions. In either position, the spring 40 urges the front extrusion 14 in a direction to maintain its integral concave hinge formation snugly against the integral convex formation 30 of the back extrustion 16.

Figure 4:
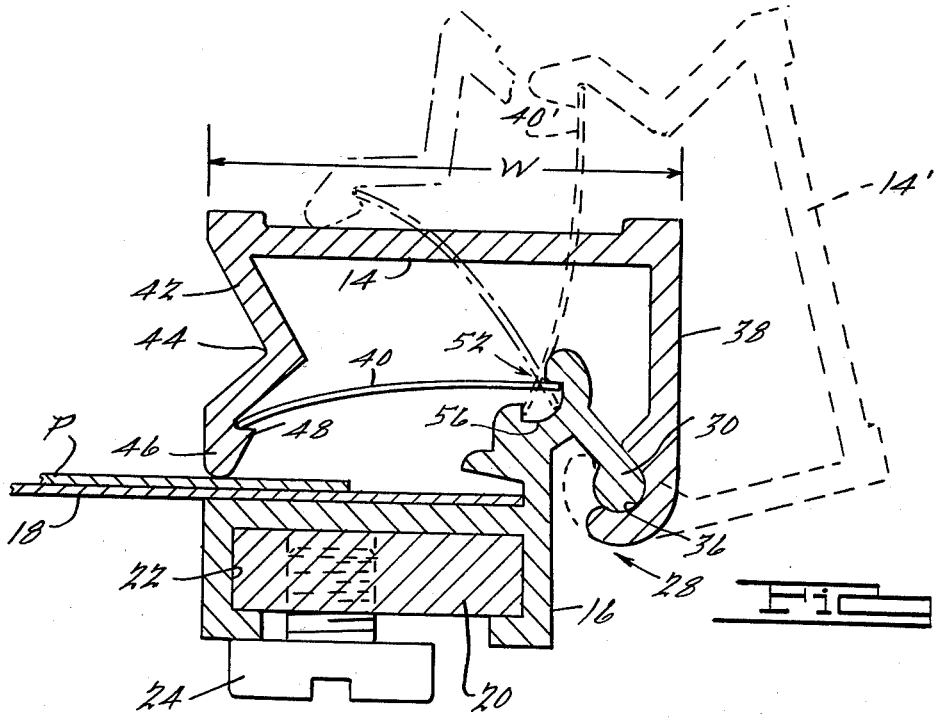
FIG. 4 is a cross-sectional view of another embodiment of the invention.

Another embodiment of the invention is shown in FIG. 4. This embodiment is designed for applications in which a small frame or one having frame sections 12 of small dimensions, is desired. Most of the parts of the frame shown in FIG. 4 are similar to those above-described with reference to FIGS. 1-3 and are numbered in the same manner. The primary differences are the width W of the cover 14 and base 16, as well as the positioning of the brace 20 in the recess 22. The unique spring mechanism 40 and mating recesses allow the frame sections to be designed with very small dimensions, such as W on the order of three-quarters of an inch, and still allow the frame sections to operate with the same efficiency as much larger frame sections.

While specific embodiments of the invention have been illustrated and described, it is to be understood that these embodiments are provided by way of example only and that the invention is not to be construed as being limited thereto, but only by the scope of the following claims.

I claim:

1. A display holder having a plurality of frame sections forming a polygonal frame structure to receive and hold a display piece, each of said sections having a pair of front and back parts adapted to be assembled in pivotal relationship with one another, said parts being provided with coacting hinge formations integral therewith and in mating pivotal engagement with one another, the improvement therein comprising first channel means formed in said back part, second channel means formed in said front part, and a spring means positioned in and extending between said first and second channel means, said spring means comprising a generally planar piece piece of material without any bends or folds therein, and said first channel means substantially enclosing one end of said spring means and having an arcuate-shaped center portion flanked on both sides by substantially flat wall portions.

2. The invention as defined in claim 1 wherein said spring means comprises a substantially flat rectangularly shaped piece of material.

3. The invention as defined in claim 1 wherein the planes of said wall portions are substantially perpendicular to one another and said center portion comprises an arc of 90°.

4. A poster display frame having a plurality of sections forming a polygonal-shaped structure for receiving, holding and displaying the display indicia, each of said frame sections comprising a front portion and back portion hinged together in pivotal relationship to one another and a spring for biasing the two frame portions together and holding them in closed and open positions for respectively clamping in place and removing said display indicia, said spring extending between said two frame portions and positioned in channels in each of said portions, the improvement therein comprising said channel in in said back portion having an arcuate-shaped center portion and two substantially flat side wall portions substantially enclosing one end of said spring thereby allowing said one end to move in said channel but not be dislodged therefrom during pivotal operation of said two frame portions.

5. The invention as defined in claim 4 wherein said spring means comprises a substantially flat rectangularly shaped piece of material.

6. The invention as defined in claim 4 wherein said channel comprises an arc of 90°.

7. The invention as defined in claim 4 wherein the planes of said wall portions are substantially perpendicular to one another.

8. The invention as defined in claim 4 wherein the length of said spring is greater than the distance between said channels and said spring has a bowed shape.

9. The invention as defined in claim 4 wherein said spring biases the front portion between a closed position in clamping engagement with said display indicia and an open position to removably receive said display indicia.

10. A display holder having a plurality of frame sections forming a polygonal frame structure to receive and hold a display piece, each of said sections having a pair of front and back parts adapted to be assembled in pivotal relationship with one another, said parts being provided with coacting hinge formations integral therewith and in mating pivotal engagement with one another, the improvement comprising first channel means formed in said back part, second channel means formed in said front part, and a spring means positioned in and extending between said first and second channel means, said spring means comprising a generally planar piece of material without any bends or folds therein and having a length greater than the distance between said first and second channel means so that said spring means is bowed when positioned therebetween, and said first channel means substantially enclosing one end of said spring means.

11. The invention as defined in claim 10 wherein said spring means comprises a substantially flat rectangularly shaped piece of material.

12. The invention as defined in claim 10 wherein first channel means has an arcuate shaped center portion flanked on both sides by substantially flat wall portions.

13. The invention as defined in claim 12 wherein the planes of said wall portions are substantially perpendicular to one another and said center portion comprises an arc of 90°.

* * * * *

UNITED STATES PATENT AND TRADEMARK OFFICE

CERTIFICATE OF CORRECTION

PATENT NO. : 4,145,828

DATED : March 27, 1979

INVENTOR(S) : David U. Hillstrom

It is certified that error appears in the above–identified patent and that said Letters Patent are hereby corrected as shown below:

Claim 1, line 37 piece, piece (one "piece" should be eliminated)

Claim 4, line 60, in, in (one "in" should be eliminated)

Signed and Sealed this

*Fourth* Day of *December 1979*

[SEAL]

*Attest:*

SIDNEY A. DIAMOND

*Attesting Officer*

*Commissioner of Patents and Trademarks*